US009151118B2

(12) United States Patent
Robson et al.

(10) Patent No.: US 9,151,118 B2
(45) Date of Patent: Oct. 6, 2015

(54) REAMER

(75) Inventors: Daniel John Robson, Okotoks (CA); Paul Allan Sibbald, Calgary (CA); Laurier E. Comeau, Ldeuc (CA); Christopher Konschuh, Calgary (CA)

(73) Assignee: Arrival Oil Tools, Inc. (CA)

( * ) Notice: Subject to any disclaimer, the term of this patent is extended or adjusted under 35 U.S.C. 154(b) by 714 days.

(21) Appl. No.: 12/955,478

(22) Filed: Nov. 29, 2010

(65) Prior Publication Data

US 2012/0132469 A1 May 31, 2012

(51) Int. Cl.

| | |
|---|---|
| ***E21B 10/26*** | (2006.01) |
| ***E21B 10/62*** | (2006.01) |
| ***E21B 17/10*** | (2006.01) |

(52) U.S. Cl.

CPC ..... *E21B 10/26* (2013.01); *E21B 10/62* (2013.01); *E21B 17/1078* (2013.01)

(58) Field of Classification Search

CPC ..... E21B 10/26; E21B 10/003; E21B 10/62; E21B 17/1078; E21B 10/43

USPC ..... 175/61, 62, 323, 324, 325.1, 355.4, 175/326, 394, 406

See application file for complete search history.

(56) References Cited

U.S. PATENT DOCUMENTS

| | | | | |
|---|---|---|---|---|
| 2,911,195 | A * | 11/1959 | Backer | 175/383 |
| 4,156,374 | A * | 5/1979 | Shwayder | 76/108.2 |
| 4,285,407 | A * | 8/1981 | Samford | 175/323 |
| 4,385,669 | A | 5/1983 | Knutsen | |
| 4,407,377 | A | 10/1983 | Russell | |
| 4,467,879 | A * | 8/1984 | Burge | 175/325.4 |
| 4,491,187 | A | 1/1985 | Russell | |
| 5,010,789 | A * | 4/1991 | Brett et al. | 76/108.2 |
| 5,040,620 | A | 8/1991 | Nunley | |
| 5,050,692 | A | 9/1991 | Beimgraben | |
| 5,868,212 | A | 2/1999 | McManus | |
| 6,213,229 | B1 | 4/2001 | Majkovic | |
| 6,223,840 | B1 | 5/2001 | Swietlik | |
| 6,328,119 | B1 | 12/2001 | Gillis et al. | |

(Continued)

FOREIGN PATENT DOCUMENTS

| | | |
|---|---|---|
| EP | 1811124 | 7/2007 |
| EP | 1811126 | 7/2007 |

(Continued)

OTHER PUBLICATIONS

Great Britain Combined Search and Examination Report for GB Application No. 1108233.6, dated Jul. 20, 2011, 6 pages.

Great Britain Search Report for GB Application No. 1108233.6, dated Nov. 29, 2011, 4 pages.

AnderGauge Drilling Systems DART Tool Webpage, printed May 4, 2010, 1 page.

(Continued)

*Primary Examiner* — Elizabeth Gitlin

(74) *Attorney, Agent, or Firm* — Blank rome LLP.

(57) ABSTRACT

A downhole apparatus for reaming a borehole incorporates two sets of cutting structures into two integral blade stabilizers, one oriented downhole and the other oriented uphole. The cutting structures comprise polycrystalline diamond cutters that are brazed into a wedge of steel that is inserted into the body of the reamers in an axial direction and retained by a stop block and retention cover that is bolted into the reamer. The two integral blade stabilizers have a combination left hand/right hand blade wrapping to provide 360° support around the circumference of the reamer. Between the two stabilizers, an impeller and a flow accelerator agitate cuttings on the low side of the borehole to mix the cuttings in with the drilling mud.

17 Claims, 7 Drawing Sheets

(56) References Cited

U.S. PATENT DOCUMENTS

| | | | | |
|---|---|---|---|---|
| 6,622,803 | B2 * | 9/2003 | Harvey et al. | 175/325.3 |
| 6,732,821 | B2 | 5/2004 | Boulet | |
| 6,776,247 | B1 | 8/2004 | Bassal | |
| 7,182,160 | B2 | 2/2007 | Boulet | |
| 2005/0241858 | A1 | 11/2005 | Eppink et al. | |
| 2010/0175927 | A1 | 7/2010 | Zulak | |
| 2010/0258318 | A1 | 10/2010 | Wolf | |

FOREIGN PATENT DOCUMENTS

| | | |
|---|---|---|
| GB | 2334541 | 8/1999 |
| GB | 2359105 | 8/2001 |
| GB | 2366815 | 3/2002 |
| GB | 2411919 | 9/2005 |
| GB | 2428508 | 11/2007 |
| GB | 2438508 | 11/2007 |
| GB | 2473094 | 3/2011 |
| WO | 9905391 | 2/1999 |
| WO | 0235055 | 5/2002 |
| WO | 2004029402 | 4/2004 |
| WO | 2009/046077 | 4/2009 |

OTHER PUBLICATIONS

Halliburton Gauge Stabilizers (AGS) Overview Webpage, printed May 4, 2010.
Hydrastab Variable Gauge Stabilizer Information Webpages, printed May 4, 2010, 3 pages.
Great Britain Search Report and Search Opinion for GB Application No. 1012594.6, dated Oct. 7, 2010, 6 pages.
Halliburton Security DBS Drill Bits; Cuttings Bed Impeller (CBI) Information Sheet, © 2008 Halliburton, 2 pages.
Halliburton Steerable Motors; Near Bit Reamer (NBR) Tool Information Sheet, © 2009 Halliburton, 2 pages.
Halliburton Hole Enlargement; UnderReamer (UR) Tool Information Sheet, © 2009 Halliburton, 2 pages.
Halliburton Rotary Steerable Systems; "Provides Reliable, Quality Hole Enlargement While Drilling," Information Sheet, © 2009 Halliburton, 2 pages.
Weatherford, Hydroclean Drill Pipe, 5" OD-NC 50 Information Sheet, © 2003 Weatherford, 2 pages.
VA Drilling, "Hydroclean—Reducing Non-Productive Time" Information Sheet, 3 pages.
Weatherford, RipTide Drilling Reamer Information Sheet, © 2009 Weatherford, 2 pages.

* cited by examiner

REAMER

TECHNICAL FIELD

The present invention relates to the field of directional drilling, and in particular to a reamer suitable for use in downhole drilling operations.

BACKGROUND ART

Directional drilling involves controlling the direction of a wellbore as it is being drilled. It is often necessary to adjust the direction of the wellbore frequently while directional drilling, either to accommodate a planned change in direction or to compensate for unintended and unwanted deflection of the wellbore.

In the drill string, the bottom-hole assembly is the lower portion of the drill string consisting of the bit, the bit sub, a drilling motor, drill collars, directional drilling equipment, and various measurement sensors. Typically, drilling stabilizers are incorporated in the drill string in directional drilling. The primary purpose of using stabilizers in the bottom-hole assembly is to stabilize the bottom-hole assembly and the drilling bit that is attached to the distal end of the bottom-hole assembly, so that it rotates properly on its axis. When a bottom-hole assembly is properly stabilized, the weight applied to the drilling bit can be optimized.

A secondary purpose of using stabilizers in the bottom-hole assembly is to assist in steering the drill string so that the direction of the wellbore can be controlled. For example, properly positioned stabilizers can assist in increasing or decreasing the deflection angle of the wellbore by supporting the drill string near the drilling bit or by not supporting the drill string near the drilling bit.

Drilling operators frequently have a need to open up tight restrictions in a borehole prior to running casing, liners, and packers in the hole. In addition, reamers may be used to remove ledges in the borehole profile. Reaming a borehole reduces the frequency of stuck pipe, helps in running wireline tools that may get stuck on ledges, and reduces the frequency of stick slip, which reduces the amount of vibration and the damage to the bottom hole assembly and the drilling bit.

In addition, reaming or opening a borehole reduces the annular fluid velocities to manage the equivalent circulating density (ECD) more effectively, an important factor in the drilling of a well.

SUMMARY OF INVENTION

A downhole apparatus for reaming a borehole incorporates two sets of cutting structures into two integral blade stabilizers, one oriented downhole and the other oriented uphole. The cutting structures comprise polycrystalline diamond cutters that are brazed into a wedge of steel that is inserted into the body of the reamers in an axial direction and retained by a stop block and retention cover that is bolted into the reamer. The two integral blade stabilizers have a combination left hand/right hand blade wrapping to provide 360° support around the circumference of the reamer. Between the two stabilizers, an impeller and a flow accelerator agitate cuttings on the low side of the borehole to mix the cuttings in with the drilling mud.

A method of enlarging a borehole uses a reamer such as is described above, stabilizing the reamer in the borehole and enlarging the borehole with the cutting sections. In one embodiment, the reamer can enlarge the borehole when moving both downhole and uphole.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

In describing various locations in the following description, the term "downhole" refers to the direction along the longitudinal axis of the wellbore that looks toward the furthest extent of the wellbore. Downhole is also the direction toward the location of the drill bit and other elements of the bottom-hole assembly. Similarly, the term "uphole" refers to the direction along the longitudinal axis of the wellbore that leads back to the surface, or away from the drill bit. In a situation where the drilling is more or less along a vertical path, downhole is truly in the down direction and uphole is truly in the up direction, but in horizontal drilling, the terms up and down are ambiguous, so the terms downhole and uphole are used to designate relative positions along the drill string. Similarly, in a wellbore approximating a horizontal direction, there is a "high" side of the wellbore and a "low" side of the wellbore, which refer to those points on the circumference of the wellbore that are closest and farthest, respectively, from the surface of the land or water.

Figure 1:
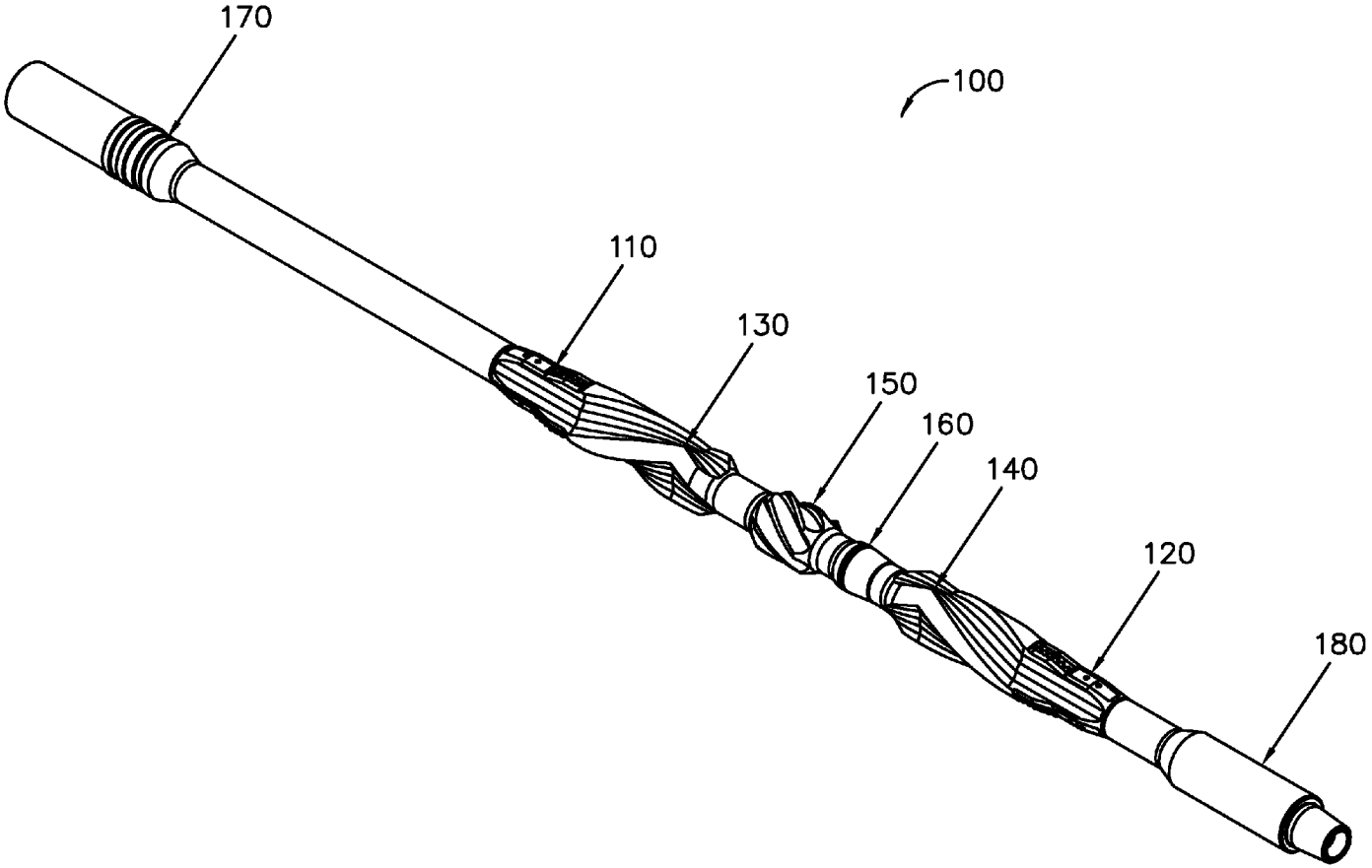
FIG. 1 is an isometric view illustrating a reamer according to one embodiment.

FIG. 1 illustrates a reamer 100 according to one embodiment. The reamer 100 provides two sets of cutting structures, a plurality of uphole cutting structures 110 and a plurality of downhole cutting structures 120, which are built into two integral blade (IB) stabilizers 130 and 140.

In between the stabilizers 130 and 140 are a helical feature 150 that acts as an impeller and a flow accelerator 160. The impeller 150 and flow accelerator 160 are used to agitate the cuttings that are lying on the low side of the borehole in a horizontally drilled borehole as is described in more detail below.

Couplings 170 and 180 on each end of the reamer 100 allow coupling of the reamer 100 into a drill string.

The IB stabilizers 130 and 140 are rotating block stabilizers that are incorporated into the reamer 100 and rotate with the reamer 100 as the drill string rotates. Although illustrated in FIG. 1 as fixed gauge IB stabilizers, the IB stabilizers 130 and 140 may be implemented in other embodiments as adjustable gauge stabilizers, providing the ability to adjust to the Gage during the drilling process.

As illustrated in FIG. 1, the IB stabilizers 130 and 140 comprise wrapped blades. The downhole IB stabilizer 140 has what is known in the industry as a "right-hand left-hand combination wrap." In a right-hand configuration, from a viewpoint looking downhole, the orientation of the helical pattern in the blades about the axis of rotation is clockwise, and can be described as having a "right-hand" convention, as that convention is often used in the industry to define an analogous torque application. This orientation is consistent also with the direction of rotation of the drill string. Conversely, a "left-hand wrap" would show a bias of curvature in the opposite direction. A right-hand left-hand combination wrap contains elements that are oriented in both a right-hand and a left-hand direction. In one embodiment, the uphole IB stabilizer 130 has a right-hand left-hand combination wrap. Other embodiments may use IB stabilizers 130 and 140 with different wrap configurations.

Although an IB stabilizer having straight blades is suitable for slide drilling, straight blades tend to cause shock and vibration in the bottom-hole assembly when rotary drilling. Wrapped blades such as illustrated in FIG. 1 may limit vibration in the bottom-hole assembly when the drill string is rotated.

The IB stabilizers 130 and 140 are symmetrically spaced around the impeller 150, to minimize shock and vibration on the bottom-hole assembly and other drill string components. Because both stabilizer 130 and stabilizer 140 use a right-hand left-hand combination wrap, the stabilizers 130 and 140 provide 360° support for the stabilizer blades and aid in the reduction of shock and vibration. The IB stabilizers 130 and 140 allow the reamer 100 to maintain a directional path of the wellbore while the reamer 100 enlarges the borehole. The reamer 100 exhibits neutral directional behavior because of the symmetrical placement and combined left-hand/right-hand symmetry of the IB stabilizers 130 and 140.

In one embodiment, the stabilizer blades are spaced apart around the circumference of the IB stabilizers 130 and 140 with a large spacing to reduce the chance of cuttings accumulating between the blades and packing off that particular portion of the IB stabilizer 130 or 140.

The outer diameter of the IB stabilizers 130 and 140 are typically very near that of the drill bit diameter, thus the stabilizers contact will nearly contact the wall of the wellbore at all times. The stabilizers 130 and 140 keep the advancement of the drill bit proceeding in a straight line, preventing any further curvature of the wellbore trajectory until the drill string is reconfigured. The stabilizers must therefore be of a highly robust design and construction to withstand the extremely high loads that are imported to the stabilizers when they experience contact with the wall of the wellbore. In addition, the action of the cutting structures 110 and 120 adds stress on the blades of the stabilizers 130 and 140.

As illustrated in FIG. 1, the impeller 150 is positioned symmetrically between the IB stabilizers 130 and 140. The flow accelerator 160 is disposed between the impeller 150 and the downhole IB stabilizer 140. These features are described in more detail below when describing FIGS. 6 and 7.

Figure 2:
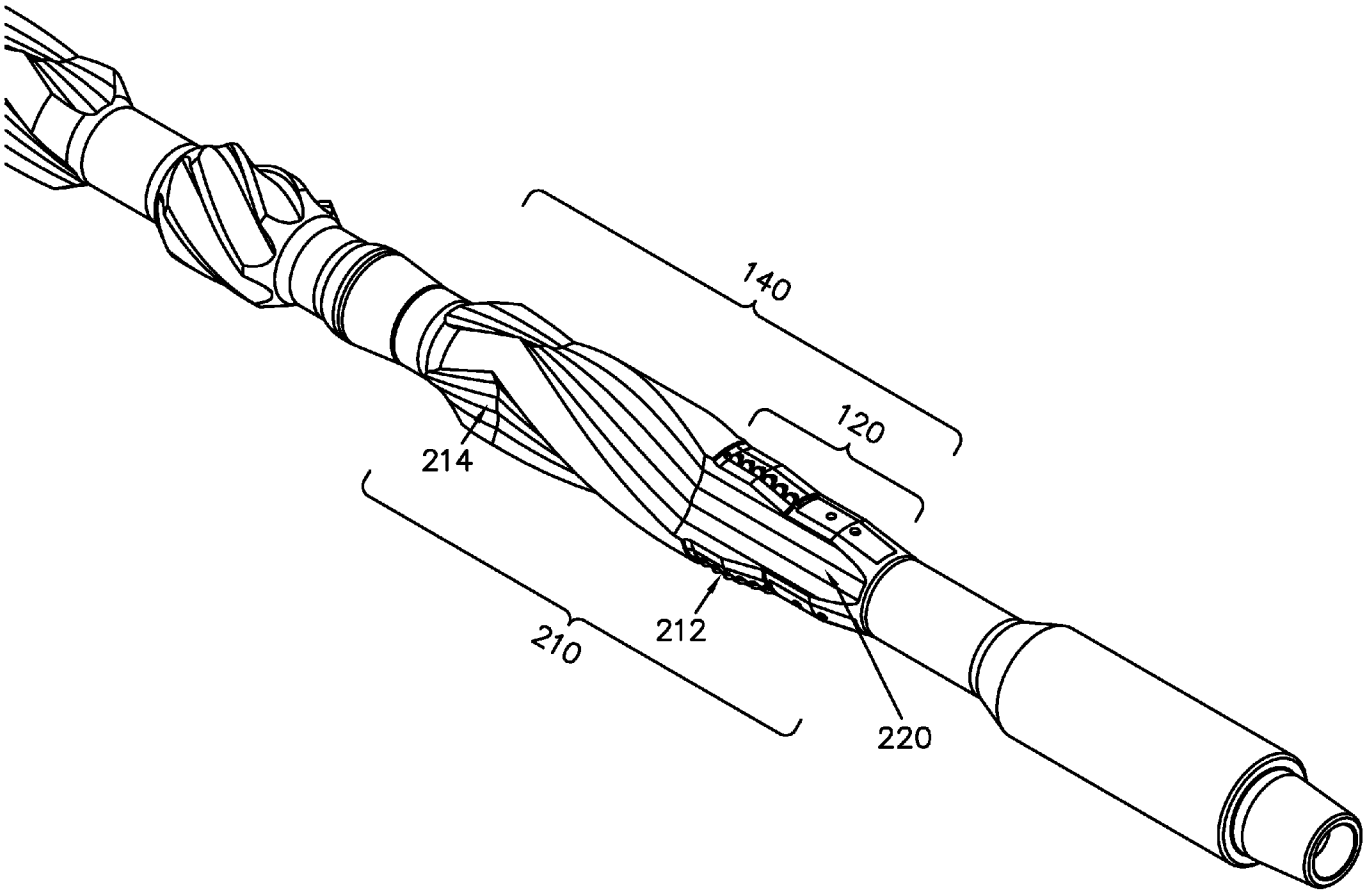
FIG. 2 is an enlarged isometric view illustrating a portion of the reamer of FIG. 1.

FIG. 2 is an isometric view of the downhole end of the reamer 100 of FIG. 1, illustrating the IB stabilizer 140 and cutting structure 120 in greater detail. As can be seen in FIG. 2, stabilizer 140 comprises three blade members 210 equally spaced about the central axis of the reamer 100. The blade members 210 form three groove portions 220 between the blade members 210 for fluid flow on the outside of the stabilizer 140. A passageway along the central axis allows for flow of drilling fluids through the reamer 100 downhole to the bottom hole assembly. The stabilizer blade members 210 extend radially outward from the axis of the reamer 100. Each blade member comprises a hardfacing surface at the outer diameter of the blade member 210 that is capable of withstanding contact with the wall of the wellbore during drilling operations. In one embodiment, the hardfacing surface presents an arc shape for conformance with the wall of the borehole.

In one embodiment, each blade member 210 comprises a substantially straight portion 212 located at the downhole end of the blade member 210, and an angular profile 214 located at the uphole end portion of the blade member 210. The angular profile 214 in one embodiment comprises a chevron or V-shaped portion having an apex in a counterclockwise direction relative to a downhole direction along the central axis. In one embodiment, the apexes of the angular portion 214 of each blade member 210 are in circumferential alignment.

The numbers and configurations of the IB stabilizers 130 and 140 are illustrative and by way of example only, and other numbers and configurations can be used, including straight (non-wrapped) IB stabilizers.

The stabilizer 130 is essentially identical to the stabilizer 140, but oriented in the opposite direction. The cutting structures 110 and 120 are positioned distal to the impeller 150 and flow accelerator 160 in both stabilizers 130 and 140. The cutting structures 110 and 120 are disposed in the straight portions 212 of each stabilizer blade 210.

Figure 3:
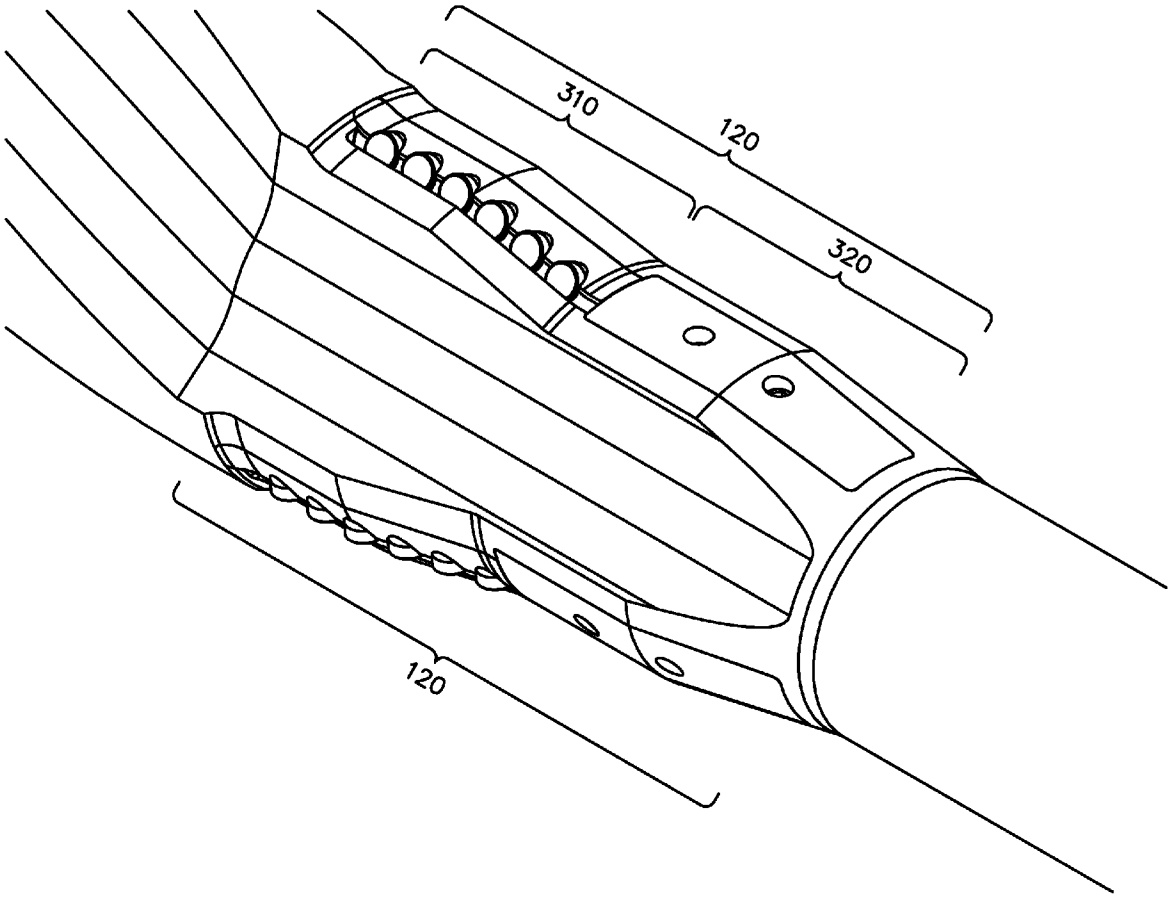
FIG. 3 is an enlarged isometric view illustrating a cutting structure of the reamer of FIG. 1
Figure 4:
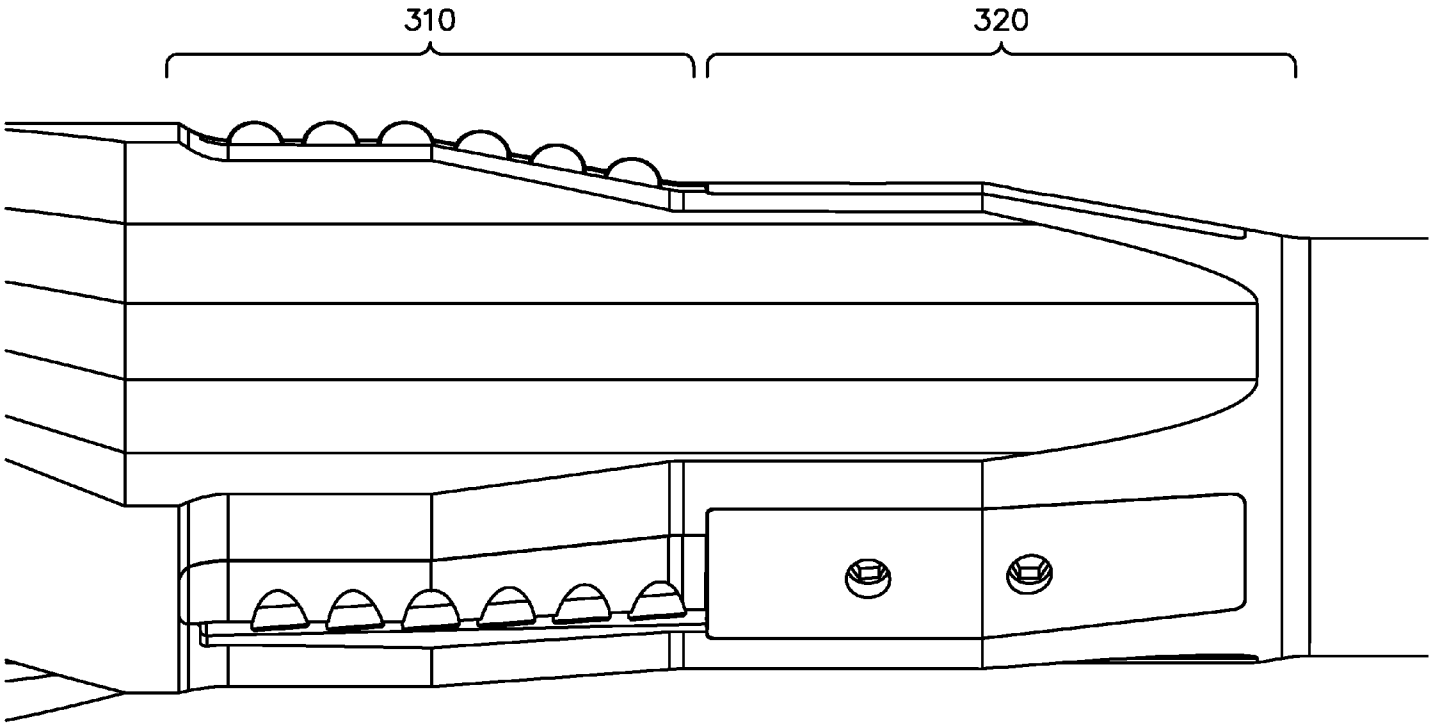
FIG. 4 is an enlarged side elevation view illustrating the cutting structure of FIG. 3.

Turning now to FIGS. 3 and 4, a cutting structure 120 is illustrated in greater detail according to one embodiment. FIG. 3 illustrates in an isometric view of the cutting structure 120 as assembled into the reamer 100. Each cutting structure 120 comprises a steel wedge section 310 into which a plurality of polycrystalline diamond cutter (PDC) inserts are brazed or otherwise held. FIG. 4 provides an elevation view of the cutting structure 120, allowing a view of the profile of the wedge section 310 and the retention section 320 along the length of the reamer 100. The wedge section 310 is inserted into a portion of a blade of the IB stabilizer 140 and retained by a retention section 320. The use of PDC inserts is illustrative and by way of example only, and other cutters that offer durability, hardness, and impact strength may be used as desired.

Figure 5:
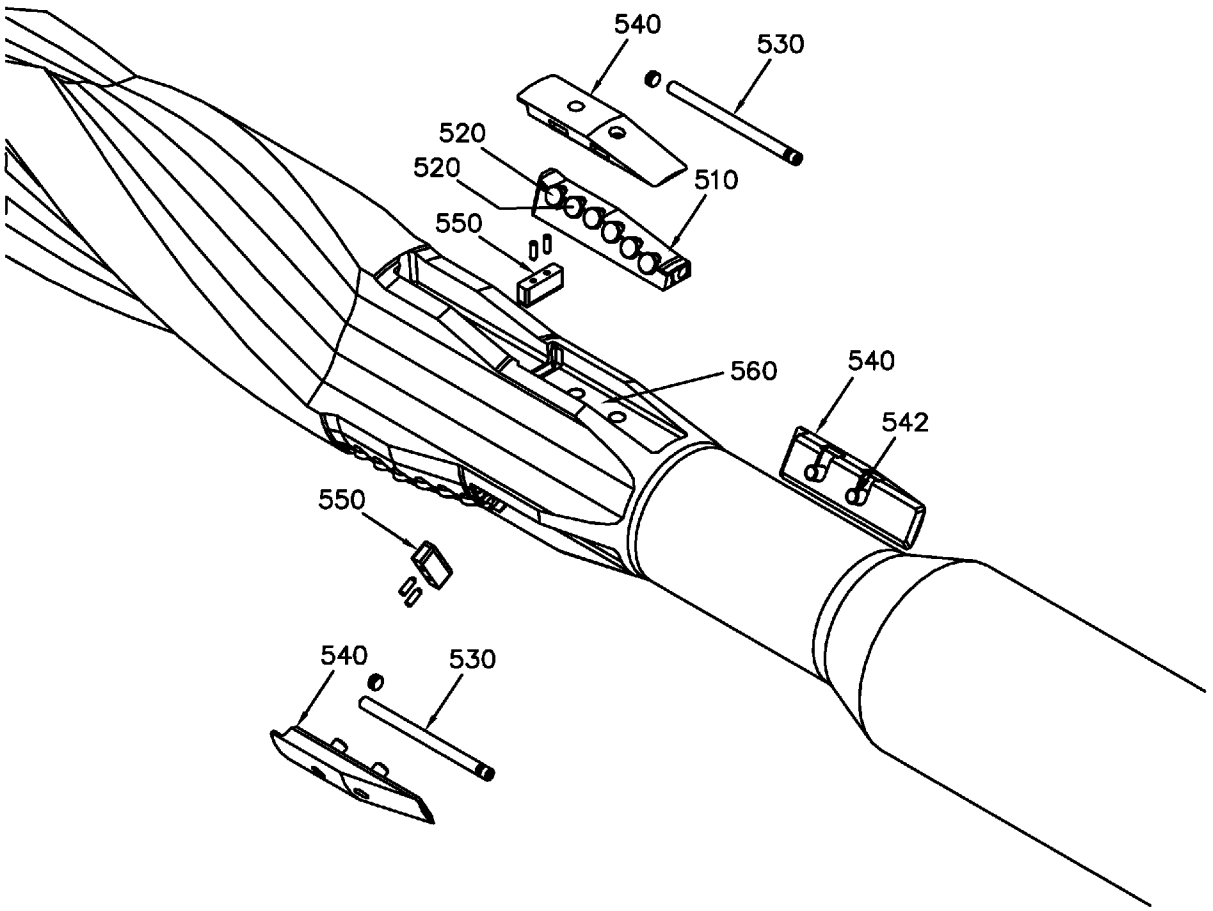
FIG. 5 is an exploded isometric view of the cutting structures of the reamer of FIG. 1.

FIG. 5 is an exploded view illustrating one embodiment for constructing the cutting structure 120. A steel wedge 510 is inserted in the axial direction into a trough 560 formed in a portion of the blades 210. In one embodiment, a bolt 530 runs longitudinally through the wedge 510. Because mud will get caked in and around the steel wedge 510, making it hard to remove for servicing, the bolt 530 may be used as a removal tool, allowing a drilling operator to jack the wedge out of the body of the reamer 100 with the bolt 530. The PDCs 520 are brazed or otherwise firmly attached to the wedge 510 with the cutting side of the PC oriented in the direction of rotation of the reamer 100, presenting the profile illustrated in FIG. 4. In one embodiment, the PDCs 520 are placed on the steel wedges 510 to improve cutting efficiency by sharing workloads evenly across all of the PDCs 520.

The wedge 510 is further retained by a stop block 550 that is disposed under one end of a retention cover 540. A stop block 550 may be pinned into the blade 210. The retention cover 540 covers the stop block 550 and may be bolted using bolts 542 or otherwise removably affixed to the blade 210.

As illustrated in FIG. 5, three sets of wedges 510 are used in one embodiment. This number is illustrative and by way of example only, and other numbers may be used. In one embodiment, an equal number of cutting structures 110 and 120 are used in both the downhole and uphole IB stabilizers 130 and 140, but in other embodiments, the uphole and the downhole stabilizers 130 and 140 may comprise different numbers of cutting structures 110 and 120.

As illustrated in FIGS. 3-5, each wedge section 510 holds six round PDCs 520. Other numbers and shapes of PDCs 520 may be used as desired. Although positioned on the downhole end of the downhole IB stabilizer 140 and the uphole end of the uphole IB stabilizer 130, the cutting structures 110 and 120 may be positioned elsewhere as desired.

In one embodiment, the retention section 320, comprising the stop block 550 and retention cover 540, is designed to retain the wedge section 310, comprising the wedge 510 and PDCs 520, such that in use all of the loading on the PDCs 520 is transmitted through the wedge 510 into the body of the reamer 100. In such an embodiment, no loads are placed on the bolts 542 that attach the retention cover 540 to the reamer 100. The embodiment illustrated in FIGS. 3-5 is designed to be easily field serviceable, allowing easy replacement of the wedge 510 and PDCs 520 as needed.

By using two cutting structures 110 and 120, one facing uphole and one facing downhole, the reamer 100 can act in either an uphole or a downhole direction.

Figure 7:
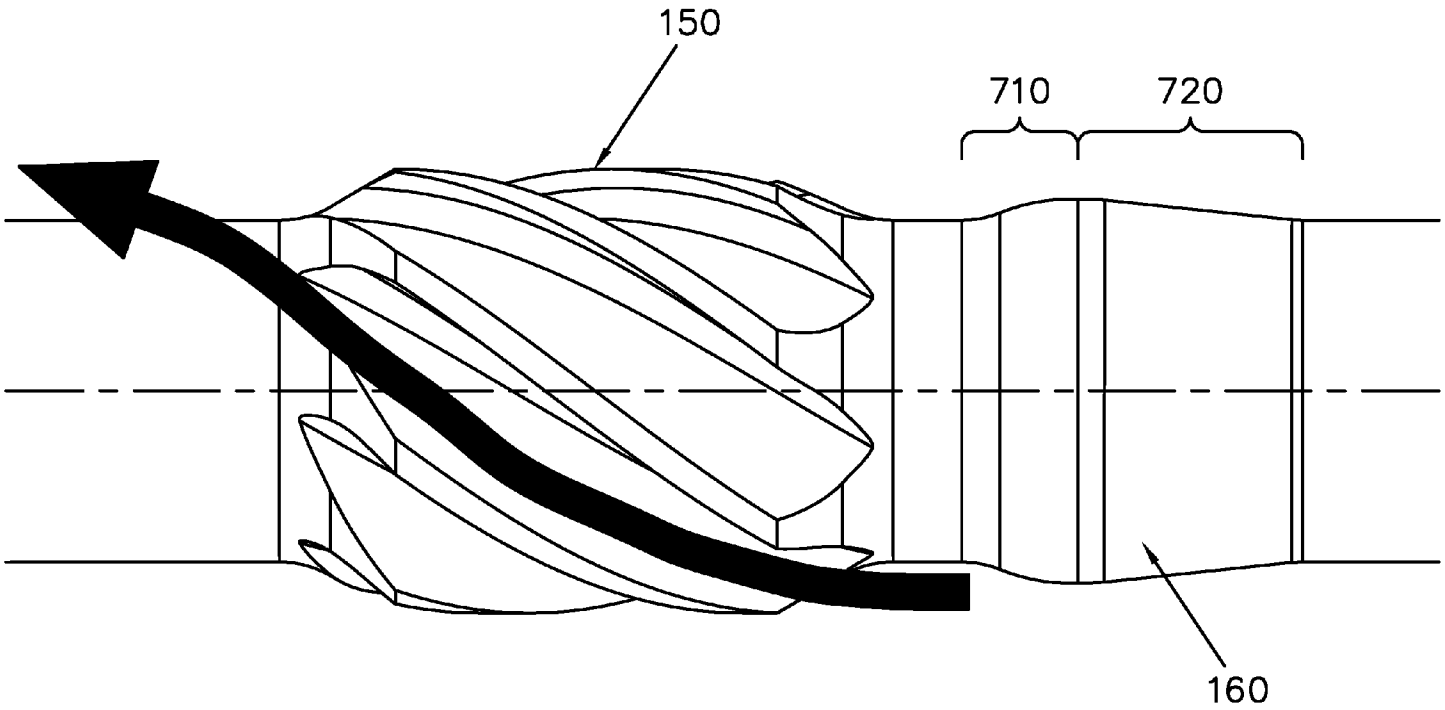
FIG. 7 is an elevation view of an impeller and a flow accelerator according to one embodiment.

FIG. 7 is a view of an impeller 150 and a flow accelerator 160 according to one embodiment. The impeller 150 and flow accelerator 160 are used to agitate cuttings that are lying on the low side of the borehole. Cuttings lying on the low side of the borehole tend to cause torque and drag problems during drilling operations, as well as tripping and swabbing problems when the drill pipe is run into or pulled out of the borehole. The impeller 150 and flow accelerator 160 are designed to pick up the cuttings from the low side of the borehole and mix them with the drilling fluid that is moving to the surface of the borehole. That allows removal of the cuttings from the borehole so that the cuttings do not interfere with normal drilling operations.

In horizontal drilling, the drill bit is frequently directed at an angle at or near horizontal, and may continue in that trajectory for great distances. The flow of the drilling mud inside the wellbore is parallel with the axis of the wellbore, thus is at or near horizontal, so the cuttings are not only carried horizontally by the viscous force of the mud, but are also acted upon vertically downward by the public gravity. The viscous forces imparted by the mud when traveling horizontally often cannot overcome the gravity forces, thereby allowing the cuttings to congregate in higher densities along the low side of the horizontal wellbore.

This accumulation of cuttings poses various problems with drilling process. The higher density of cuttings on the low side of the wellbore increases drag on the drill string by causing contact and interference with the rotational as well as translational movement of the drill string pipe and other drill string components. The higher density of cuttings also increases the wear and tear on the drill string, as well as increases the likelihood of downhole problems such as stuck pipe.

Figure 6:
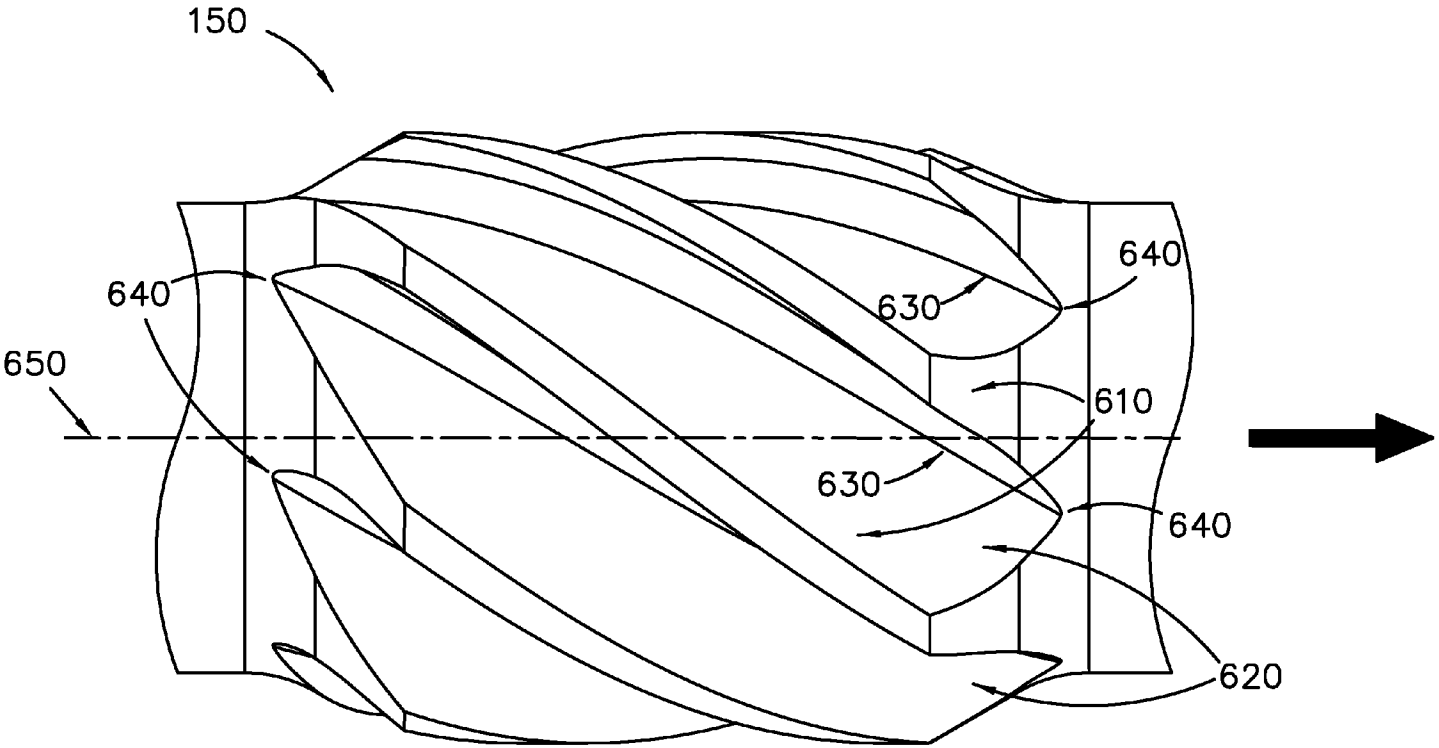
FIG. 6 is an elevation view of an impeller according to one embodiment.

In FIGS. 6 and 7, the impeller 150 comprises a plurality of blades 610, which stand outwardly in the radial direction from the axis 650 and are arranged helically around the reamer 100 in the axial direction of the reamer 100. Between each pair of adjacent blades 610 is a groove 620, whose profile shape is defined by the faces of the adjacent blades 610. At the bottom of each groove 620 is a groove base 630, which every section of the impeller 150 transfers to axis 650 contains the point on the groove that his radially closest to the axis 650 of the reamer 100. In one embodiment, the groove base 630 is represented by a single line. In other embodiments, the groove base 630 may have a defined width. In one embodiment, every point on the groove base 630 lies at the same radial distance from the axis 650, because all of the blades 610 have identical shape. The entire groove 620 forms a flow channel for the drilling fluid, demonstrated by the arrow in FIG. 7. The flow channel is open, defined herein as the condition where the radial distance of all points on the groove base 630 as measured from the axis 650 does not increase at the outer edges 640 of the groove 620, and as a result the surrounding fluid can enter and exit the flow channel without having to move toward the axis 650, and therefore the fluid is unencumbered from entering and exiting the channel. In one embodiment, the grooves 620 of the impeller 150 are open at both ends. This channel enhances the efficiency of the impeller 150 in capturing the cuttings that tend to settle toward the low side of the wellbore and moving them toward the high side of the wellbore by means of an augering effect. In other embodiments, the flow channels of the impeller 150 may be open at only one end of the impeller 150.

Because the IB stabilizers 130 and 140 are capable of withstanding the relatively high impact loads that result from contact with the wellbore wall, they are able to keep the impeller 150, which has a smaller outer diameter than that of the maximum diameter of the stabilizers 130 and 140, from having any contact with the wall of the wellbore. Therefore, the impeller 150 does not need to have the same strength and durability as the IB stabilizers 130 and 140.

In one embodiment, the pitch of the helical curves of the blades 610 is essentially the ratio of the circumferential displacement of the blade 610 relative to the axial displacement of the blades 610 across a given axial length of the impeller 150, just as pitches defined for any conventional screw.

The profile of the blades 610 of the impeller 150 is consistent throughout the length of the agitator. Likewise, the profile of the grooves 620 between the blades 610 of the impeller 150 is also consistent throughout the length of the impeller 150. The shape of the impeller blades 610 features a forward bias, such that the leading face of the blade 610 that first contacts the drilling fluid while the drill string is rotating is undercut relative to an imaginary line drawn radially from the axis 650 of the reamer 100. Thus, the agitator blades face "leans" into the fluid. This forward bias, along with the sharper pitch of the helical curve of the blades 610, produces a greater augering effect upon the drilling fluid and the entrained cuttings. Thus the blades 610 of the impeller 150 are not just stirring the cuttings within the flow stream of the mud, but are actually moving the cuttings from the low side of the wellbore where the density is at a maximum, and redistributing them to areas in the wellbore where the density of cuttings is lower.

The flow accelerator 160 is disposed between the impeller 150 and the downhole IB stabilizer 140. As best illustrated in FIG. 7, the flow accelerator 160 in one embodiment features a profile that is an enlargement of the diameter of the drill pipe that linearly increases for some length 720 in the uphole direction. Where the increasing diameter reaches its maximum, the profile of the flow accelerator 160 decreases the diameter of the flow accelerator across length 710 back to its original diameter. In one embodiment, the length 720 is longer than the length 710, so that the downhole portion of the flow accelerator 160 as a more gradual change in diameter than the uphole portion of the flow accelerator 160. The result is an upset that causes the velocity of the drilling mud to increase as it flows uphole past the flow accelerator 160. The flow of mud is also directed toward the wall of the wellbore. At the low side of the wellbore, therefore, the flow of the drilling mud is directed toward the area of cuttings settlement. The increased flow tends to produce a scouring effect on the area of cuttings settlement on the low side of the wellbore, as well as creating more turbulence on the uphole side of the flow accelerator 160. The flow accelerator 160 is disposed downhole of the impeller 150 so that this scouring and turbulence can increase the action of the impeller 150. In effect, the contoured "bulb" profile of the flow accelerator 160 directs the fluid flow into the cuttings bed and creates a jetting action at the leading edges of the blades 610 of the impeller 150.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A reamer, comprising:

a first integral blade stabilizer disposed at an uphole end of the reamer, comprising:

a blade having a right-hand left-hand combination wrap; and a cutting structure, disposed in an uphole end portion of the blade, oriented in a first rotational direction;

a second integral blade stabilizer disposed at a downhole end of the reamer, comprising:

a blade having a right-hand left-hand combination wrap; and a cutting structure, disposed at a downhole end portion of the blade, oriented in a second rotational direction, wherein the cutting structures each comprise:

a wedge section disposed in the corresponding end portion of the stabilizer blade;

a retention section disposed in the corresponding end portion of the stabilizer blade adjacent the wedge section for retaining the wedge section at one end, each retention section comprising a stop block adjacent to the wedge section; and a retention cover, disposed over the stop block; and a plurality of cutter members, affixed to the wedge section.

2. The reamer of claim 1, further comprising:

an impeller, comprising:

a plurality of blades standing radially outward from a longitudinal axis of the reamer and arranged helically about the longitudinal axis; and a flow accelerator, disposed downhole of the impeller, comprising:

a variable diameter profile about the longitudinal axis.

3. The reamer of claim 2, wherein the impeller and the flow accelerator are disposed between the first integral blade stabilizer and the second integral blade stabilizer.

4. The reamer of claim 2, wherein the variable diameter profile of the flow accelerator comprises:

a first region of increasing diameter having a first length; and a second region of a decreasing diameter, having a second length less than the first length.

5. The reamer of claim 2, wherein the flow accelerator is configured to increase velocity of a drilling fluid that passes over the flow accelerator.

6. The reamer of claim 2, wherein the flow accelerator is configured to increased pressure in turbulence against a wall of a wellbore.

7. The reamer of claim 2, wherein the impeller has a maximum outer diameter less than a maximum outer diameter of the first integral blade stabilizer and the second integral blade stabilizer.

8. The reamer of claim 2, wherein the plurality of blades of the impeller have a rotational orientation corresponding to the second rotational direction.

9. The reamer of claim 1, further comprising:

a pair of end couplings configured for fixing the reamer to a drill string.

10. The reamer of claim 1, wherein the plurality of cutter members are positioned with the wedge section for even load sharing during drilling operations.

11. The reamer of claim 1, wherein a cutting load on the wedge section is born by the blade.

12. An integral blade stabilizer for a reamer, comprising:

a plurality of blades spaced about a central axis of the integral blade stabilizer, each having a right-hand left-hand combination wrap;

a plurality of cutting sections, each comprising:

a wedge section disposed in an end portion of a blade;

a retention section, disposed in the corresponding end portion of the blade adjacent the wedge section, configured to retain the wedge section at one end, each retention section comprising a stop block adjacent to the wedge section;

a retention cover, disposed over the stop block; and a plurality of cutters, each affixed to the wedge section.

13. The integral blade stabilizer of claim 12, wherein the plurality of cutters are comprised of polycrystalline diamond cutters.

14. The integral blade stabilizer of claim 12, wherein the plurality of cutters are spaced on the wedge section for even loading during drilling operations.

15. A method of reaming a borehole, comprising:

stabilizing a reamer with an opposed pair of integral blade stabilizers, each having a right-hand left-hand combination wrap; and enlarging the borehole with cutting structures embedded in blades of the integral blade stabilizers, wherein the cutting structures comprise:

a wedge section disposed in an end portion of a blade;

a retention section, disposed in the corresponding end portion of the blade adjacent the wedge section, configured to retain the wedge section at one end, each retention section comprising a stop block adjacent to the wedge section;

a retention cover, disposed over the stop block; and a plurality of cutters, each affixed to the wedge section, wherein the cutting structures of one of the opposed pair of integral blade stabilizers is oriented in a first rotational direction and the cutting structures of the other of the opposed pair of integral blade stabilizers is oriented in a second rotational direction, opposite to the first rotational direction.

16. The method of claim 15, further comprising:

accelerating flow of a drilling fluid toward an impeller; and mixing cuttings from a low side of the borehole into the drilling fluid with the impeller.

17. The method of claim 15, wherein the act of enlarging the borehole comprises:

enlarging the borehole while moving the reamer in a downhole direction; and enlarging the borehole while moving the reamer in uphole direction.

* * * * *